United States Patent [19]

Seragnoli

[11] Patent Number: 4,524,781

[45] Date of Patent: Jun. 25, 1985

[54] CIGARETTE-MAKING MACHINE WITH AN AUXILIARY TOBACCO SUPPLY UNIT

[75] Inventor: Enzo Seragnoli, Bologna, Italy

[73] Assignee: G.D Societa' per Azioni, Bologna, Italy

[21] Appl. No.: 406,031

[22] Filed: Aug. 6, 1982

[30] Foreign Application Priority Data

Sep. 24, 1981 [IT] Italy ..... 49365 A/81

[51] Int. Cl.[3] ..... A24C 5/39

[52] U.S. Cl. ..... 131/108; 131/110; 131/109.1; 131/109.3

[58] Field of Search ..... 131/108, 109 R, 110, 131/109 AB

[56] References Cited

U.S. PATENT DOCUMENTS 4,155,367 5/1979 Rudszinat et al. ..... 131/110

4,185,644 1/1980 Heitmann et al. ..... 131/110

4,373,538 2/1983 Steiniger ..... 131/110

*Primary Examiner*—Millin. V.

*Attorney, Agent, or Firm*—Marshall, O'Toole, Gerstein, Murray & Bicknell

[57] ABSTRACT

A cigarette-making machine having a main tobacco supply unit; a descending chimney for shredded tobacco, said descending chimney extending downwards from the main tobacco supply unit; an intermediate lateral aperture in the chimney; an auxiliary tobacco supply unit communicating with the chimney and comprising a shredded tobacco output conveyor having an outlet end arranged at the aperture and movable transversely thereacross to sweep a transverse section of the chimney; and an actuator connected to the output conveyor to move it transversely.

7 Claims, 3 Drawing Figures

CIGARETTE-MAKING MACHINE WITH AN AUXILIARY TOBACCO SUPPLY UNIT

BACKGROUND OF THE INVENTION

The present invention relates to a cigarette-making machine with an auxilliary tobacco supply unit.

Cigarette-making machines including an input chamber from which shredded tobacco is withdrawn by the operation of a carding unit, to be supplied to a descending chimney, are known. At the lower end of this latter there is disposed a feed conveyor which conveys tobacco towards the lower end of an ascending output chimney.

In general the said descending chimney serves as an accumulation magazine in that it constantly contains a column of tobacco from the lower end of which the tobacco is withdrawn continuously by a toothed roller which feeds it over the said conveyor. The above described known cigarette-making machines are normally fed, in part, with recycled tobacco, withdrawn downstream of the said ascending output chimney by means of shaver devices and frequently introduced directly into the said input chamber. Because of the reduced dimensions of fragments of recycled tobacco, and because of the consequent difficulty with which these are taken up by the carding unit, such a solution does not always guarantee sufficient uniformity of the level of tobacco within the descending chimney. This non-uniformity involves significant disadvantages in that it is manifested as a non-uniformity in the layer of tobacco formed by the said toothed roller on the said conveyor, and therefore as a non-uniformity in the distribution of tobacco along a continuous rod of cigarette which, as is known, is formed at the output of the said ascending chimney.

For the purpose of eliminating this disadvantage, it is known to provide within the descending chimney a plurality of level indicators distributed across the width of the chimney itself and operable to detect the height of the said column at several points. The signals emitted by these level indicators are used to correct the distribution of the tobacco taken up by the carding unit. One known correction method lies in separating the carding unit into a plurality of sub units disposed alongside one another across the width of the descending chimney, and in selectively regulating their feed speed in response to signals received from the said level indicators.

From what has been described above it will be clear that the above described known correction methods involve, in their performance, extremely complicated mechanical devices which, as well as making the associated cigarette-making machines extremely expensive, drastically reduces the reliability of these.

SUMMARY OF THE INVENTION

The object of the present invention is that of providing a cigarette-making machine in which the distribution of tobacco in the column which forms within the said descending chimney is controlled and corrected in a simple and economic manner.

The said object is achieved by the present invention in that it relates to a cigarette-making machine with an auxilliary tobacco supply unit, including a descending supply chimney for the shredded tobacco, communicating at the top with a main tobacco supply device, the said descending chimney having an intermediate aperture communicating with the output of the said auxilliary unit, characterised by the fact that the said auxilliary unit includes a conveyor for the tobacco and drive means connected to the said conveyor to displace an output end thereof with an oscillatory movement across the said aperture in a direction substantially transverse the axis of the said descending chimney.

BRIEF DESCRIPTION OF THE DRAWINGS

Further characteristics and advantages of the present invention will become better apparent from the following detailed description of a preferred embodiment illustrated purely by way of non limitative example in the attached drawings, in which.

DETAILED DESCRIPTION OF THE DRAWINGS

Figure 2:
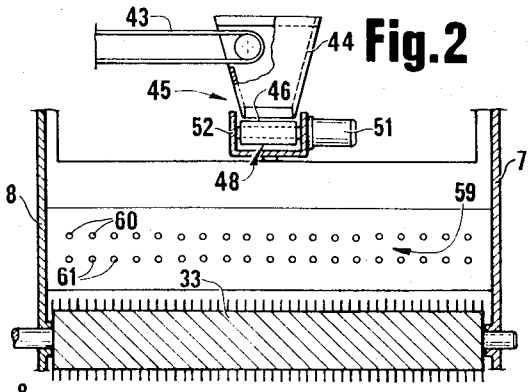
FIG. 2 shows a section of the machine of FIG. 1 taken on the line II—II.
Figure 3:
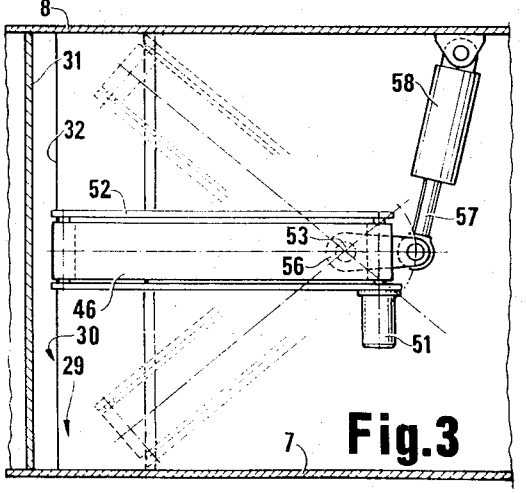
FIG 3 schematically shows a section of the machine of FIG. 1 taken on the line III—III.
Figure 1:
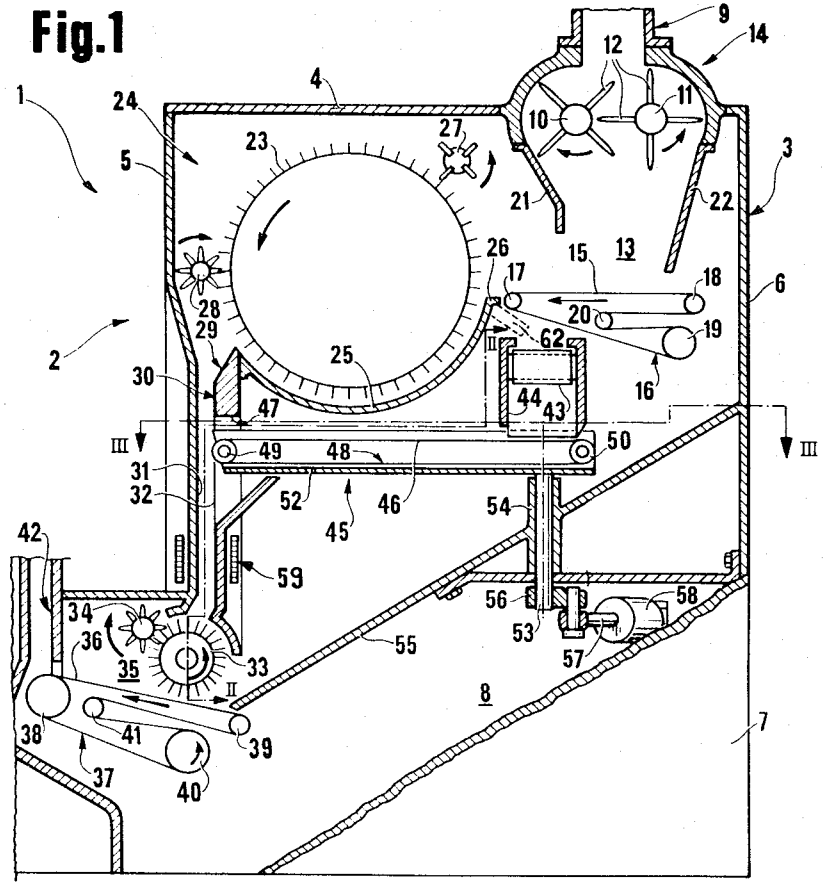
FIG. 1 is a section taken on a vertical plane schematically illustrating a part of a cigarette-making machine formed according to the principles of the present invention.

In FIG. 1 there is illustrated a cigarette-making machine 1 including a distributor 2 the purpose of which is to form a continuous and uniform flow of tobacco particles from a mass of shredded tobacco. The component members of the distributor 2 are contained in a housing 3 which extends upwardly and is closed at the top by a horizontal wall 4 and at the sides by two vertical walls 5 and 6.

On two sides parallel to the plane of FIG. 1 the housing 3 is closed by a front wall 7 and a rear or back wall 8. The upper wall 4 has an aperture communicating with an input chimney 9 having a substantially rectangular section beneath which there are disposed, within the housing 3, two driven rotatable rollers 10 and 11, provided around the whole of their circumferences with radial teeth 12. The rollers 10 and 11 turn respectively in opposite directions from one another and perform on the tobacco a preliminary carding operation conveying it towards an underlying chamber 13.

The chimney 9 and the rollers 10 and 11 together define a pre-supply unit 14 and lie over the chamber 13 the bottom of which is defined by a conveyor belt 15. This latter is constituted by the upper branch of a belt 16 wound in a loop about three deflector rollers 17,18 and 19 at least one of which is driven, and a tensioner roller 20.

Two inclined converging walls 21 and 22, both extending downwardly from the wall 4, convey the tobacco descending from the pre-supply unit 14 onto the belt 15.

On the side opposite the wall 6 the chamber 13 is delimited by a toothed carding roller 23 forming part of a carding or main feed unit 24 and lying adjacent the downstream end of the conveyor belt 15. Beneath the roller 23 there is provided a cylindrical cowl 25 coaxial therewith, which supports at one end a shaver element 26 extending between the roller 23 and the downstream end of the conveyor belt 15. As well as the roller 23 the unit 24 includes a roller 27, the said metering roller, which can rotate in the same sense as the roller 23 and is located in a position overlying and substantially tangential to this latter. As a result of this arrangement the tobacco, falling from the overlying pre-supply unit 14 onto the conveyor belt 15 is urged by this across the shaver element 26 against the carding roller 23. The carding roller 23 transfers a layer of tobacco of thickness substantially equal to the radial dimensions of its teeth, out from the chamber 13 downstream of its position tangential to the metering roller 27.

A toothed roller 28, called a thrower roller, takes the layer of tobacco from the roller 23 and projects it in the form of separate particles into an inlet hopper 29 of a substantially vertical chimney 30 delimited by two walls 31 and 32. The lower end of the chimney 30 faces the periphery of a toothed element constituted by a toothed roller 33 which operates to transfer the tobacco out from the chimney 30. A toothed roller 34, called a thrower roller, takes the tobacco from the teeth of the roller 33 projecting it, in the form of separate particles, into a chamber 35 the bottom wall of which is defined by a conveyor belt 36, called a collection conveyor, which is movable, as can be seen in FIG. 1, from right to left and inclined upwardly in the direction of its movement. The conveyor 36 is constituted by the upper branch of a belt 37 passing over three deflector rollers 38,39 and 40 at least one of which is driven, and maintained in tension by a tensioner roller 41.

The roller 38 is located adjacent the lower end of an ascending chimney 42 the upper end (not illustrated) of which communicates with a rod-forming unit (not illustrated). As is known, in the said rod-forming unit the particles of tobacco adhere to the lower face of at least one suction conveyor belt, (not illustrated) forming beneath it a layer (not illustrated) which is rendered of uniform thickness by the operation of a shaver device (not illustrated). The tobacco removed by the said shaver device is fed, by means of a conveyor (not illustrated) onto a conveyor belt 43 disposed immediately beneath the chamber 13 and terminating in a substantially vertical hopper 44.

The conveyor 43 of the hopper 44 constitutes the input to an auxilliary supply unit 45 further including a conveyor 46 the output and input ends of which communicate, respectively, with the interior of the chimney 30, through an aperture 47 in the wall 32 and as wide as the chimney 30 itself, and with the bottom of the hopper 44. This conveyor 46 is constituted by a horizontal conveyor belt 48 wound in a loop about rollers 49 and 50 at each end, the axes of which, in the drawing, are parallel to the axes of the roller 23. The rollers 49 and 50, one of which is driven by a variable speed motor 51, are supported by a support 52 which closely follows the underneath and sides of the belt 48.

Near to its end underlying the hopper 44, the support 52 is supported from beneath by the upper end of a vertical pin 53 which is rotatably engaged in a bush 54 extending through an inclined wall 55 defining the bottom of the distributor 2. On the free end of the pin 53 there is keyed a substantially horizontal lever 56 the free end of which is pivotally connected to the end of an output shaft 57 of a linear actuator 58. The operation of the actuator 58 imparts to the support 52 an oscillatory movement about the axis of the pin 53, during which one end of the conveyor 46 sweeps the chimney 30, transversely of its axis and over the whole of its width, travelling alternately in the two directional senses and adding to the tobacco coming from the carding unit 24 a substantially uniform deposit of recycled tobacco.

The speed of rotation of the motor 51 which drives the belt 48 is controlled in a known manner by a detection system 59 of optical type including detector means constituted by two sets of photodiodes 60 and 61 defining a maximum and minimum level respectively of the tobacco within the chimney 30. Upon the occurrence of a fall or rise, respectively, in the level of tobacco in the chimney 30, the detection system 59 produces an increase or decrease, respectively, in the speed of the motor 51 such as to vary as necessary the metering of the supplied recycled tobacco and to return the said level to optimum values.

Possible non-uniformity in the height of the tobacco column within the chimney 30 can then be eliminated by making the actuator 58 also dependent on the detection system 59 in a manner which it has not been considered necessary to illustrate inasmuch as it would be obvious to one skilled in the art, so as to slow down or accelerate the oscillation of the conveyor 46 about the axis of the pin 53 whereby its output end overlies zones of the chimney 30 in which the said column is, respectively, too low or too high. Obviously, the tobacco which arrives at the conveyor 46 from the hopper 44 can be withdrawn for the objects already envisaged, together with or alternatively to the said shaved tobacco, from other points of the machine 1.

In particular, in the variant illustrated with broken lines in FIG. 1, fine tobacco is supplied to the hopper 44 via a duct 62 the upper end of which communicates with the chamber 13 through a dividing wall (not illustrated) located in the position of the shaver element 26.

Naturally, the principle of the invention remaining the same, numerous modifications can be made to the apparatus described without by this departing from the scope of the present invention. The conveyor belt 48 can, for example, be replaced by a slightly inclined channel or tray (not illustrated) of the same length, associated with a vibrator device the frequency of vibration of which can be varied for the purpose already seen, under the control of the detection system 59.

I claim:

1. A cigarette-making machine comprising:

a main tobacco supply unit (24);

a descending chimney (30) for shredded tobacco, said descending chimney (30) extending downwards from said main tobacco supply unit (24);

an intermediate lateral aperture (47) provided in said chimney (30);

an auxiliary tobacco supply unit (45) communicating with said chimney (30) and comprising a shredded tobacco output conveyor (46) having an outlet end arranged at said aperture (47) and movable thereacross transversely of said chimney (30) to sweep a transverse section of the same; and actuator means (58) connected to said output conveyor (46) to impart said transverse movement thereto.

2. A machine according to claim 1 wherein said auxiliary unit (45) further comprises detector means (59) for detecting the level of tobacco within said chimney (30) and for controlling said actuator means (58) to maintain said level within a predetermined range of variation.

3. A machine according to claim 1 wherein variable speed drive means (51) are connected to said conveyor (46) to vary the capacity thereof.

4. A machine according to claim 1 wherein the said conveyor (46) includes a conveyor belt (48) which can be driven at variable velocity.

5. A machine according to claim 1 wherein the said conveyor (46) includes a channel inclined towards the said aperture (47) and a variable frequency vibrator device associated with the said channel.

6. A machine according to claim 1 wherein said auxiliary supply unit (45) comprises an inlet hopper (44) and feeding means (43) to feed said hopper with recycled tobacco.

7. A machine according to claim 1 wherein said auxiliary supply unit (45) comprises an inlet hopper (44) and a tobacco feeding duct (62) for said inlet hopper (44), the duct (42) being disposed upstream of the main supply unit (24), and a tobacco supply chamber (13) communicating with the hopper (44) via the duct (62).

* * * * *